US010639512B2

(12) United States Patent
Huang et al.

(10) Patent No.: US 10,639,512 B2
(45) Date of Patent: May 5, 2020

(54) RESISTANCE REGULATING DEVICE FOR WHEEL OF TRAINING MACHINE

(71) Applicant: Dyaco International Inc., Taipei (TW)

(72) Inventors: Feng-Ren Huang, Taipei (TW); Chih Chi Liu, Taipei (TW); Brian Murray, Taipei (TW); Peter Gillespie, Taipei (TW)

(73) Assignee: Dyaco International Inc., Taipei (TW)

( * ) Notice: Subject to any disclaimer, the term of this patent is extended or adjusted under 35 U.S.C. 154(b) by 173 days.

(21) Appl. No.: 15/925,542

(22) Filed: Mar. 19, 2018

(65) Prior Publication Data

US 2019/0262651 A1 Aug. 29, 2019

(30) Foreign Application Priority Data

Feb. 27, 2018 (TW) ..... 107106633 A

(51) Int. Cl.

| | |
|---|---|
| ***A63B 21/00*** | (2006.01) |
| ***A63B 21/22*** | (2006.01) |
| ***A63B 22/06*** | (2006.01) |
| ***A63B 21/005*** | (2006.01) |
| ***A63B 21/015*** | (2006.01) |
| ***A63B 24/00*** | (2006.01) |
| *A63B 71/00* | (2006.01) |

(52) U.S. Cl.

CPC ..... *A63B 21/0056* (2013.01); *A63B 21/0051* (2013.01); *A63B 21/00069* (2013.01); *A63B 21/00076* (2013.01); *A63B 21/015* (2013.01); *A63B 21/225* (2013.01); *A63B 24/0087* (2013.01); *A63B 22/0605* (2013.01); *A63B 22/0664* (2013.01); *A63B 2071/0081* (2013.01); *A63B 2220/54* (2013.01); *A63B 2220/805* (2013.01)

(58) Field of Classification Search

CPC ..... A63B 21/0056; A63B 21/00069; A63B 21/00076; A63B 21/015; A63B 21/225; A63B 22/0605; A63B 2220/54

See application file for complete search history.

(56) References Cited

U.S. PATENT DOCUMENTS 4,765,443 A * 8/1988 Cunningham ..... B62L 1/16 188/24.12
5,145,480 A * 9/1992 Wang ..... A63B 21/0051 482/5

(Continued)

OTHER PUBLICATIONS

STIC search patents; Kobylarz542Patents (Year: 2019).*
STIC search NPL: Kobylarz542NPL2 (Year: 2019).*

*Primary Examiner* — Loan B Jimenez
*Assistant Examiner* — Andrew M Kobylarz
(74) *Attorney, Agent, or Firm* — Donald E. Stout; Stout, Uxa & Buyan, LLP

(57) ABSTRACT

A resistance regulating device for a wheel of a training device is disclosed. The resistance regulating device comprises a rotary mechanism pivotally connected with a stationary mechanism and a motor with other components to rotate the rotary mechanism and hence a distance between magnets of the rotary mechanism and the wheel is changed. In addition, an optical detection device may be used to detect and define a minimum resistance and a maximum resistance and hence to adjust a resistance in a stepless manner. An emergency brake mechanism may be further employed.

8 Claims, 9 Drawing Sheets

(56) References Cited

U.S. PATENT DOCUMENTS

| | | | | |
|---|---|---|---|---|
| 6,099,440 | A * | 8/2000 | Schurter | A63B 21/012 482/63 |
| 6,569,063 | B2 * | 5/2003 | Chen | A63B 21/0051 482/57 |
| 9,707,430 | B2 * | 7/2017 | Wu | A63B 21/015 |
| 2014/0013861 | A1 * | 1/2014 | Wu | G01L 3/101 73/862.08 |
| 2016/0310785 | A1 * | 10/2016 | Lo | A63B 21/005 |

* cited by examiner

RESISTANCE REGULATING DEVICE FOR WHEEL OF TRAINING MACHINE

CROSS-REFERENCE TO RELATED APPLICATIONS

The entire contents of Taiwan Patent Application No. 107106633, filed on Feb. 27, 2018, from which this application claims priority, are expressly incorporated herein by reference.

FIELD OF THE INVENTION

The present invention relates to a resistance regulating device for a wheel of a training machine.

DESCRIPTION OF RELATED ART

Flywheels typically constitute rotating devices useful for storing rotational energy. A flywheel is a spinning wheel rotor with a fixed axis whereby energy is stored in the rotor as rotational energy. Flywheels have a moment of inertia and thus resist changes in rotational speed. The rotational energy is proportional to the square of its rotational speed. The rotational speed of flywheel can be increased by applying torque to it, and can be decreased by applying torque to increase mechanical load.

A fitness training machine with a flywheel on the market usually adopts a knob to adjust the resistance of flywheel. For example, Taiwan patent M503914 discloses a bike machine with a load sensing structure, which comprises a magnetic resistive-control device, a brake adjustment mechanism, and a load sensing device. The magnetic resistive-control device exerts a resistance on the flywheel. The brake adjusting mechanism has a knob, and the rotation of the knob causes the cable connected with it to drive the magnetic resistive-control device so as to change the resistance. In addition, the cable simultaneously triggers the load sensing device so that the resistance is displayed for the user.

The prior design has disadvantages of the knob of the brake adjustment mechanism and its connecting elements being not reliable and the resistance control being not accurate enough. A need has therefore arisen to improve them.

SUMMARY OF THE INVENTION

In one general aspect, the present invention introduces improved resistance regulating device for a wheel of a training machine.

In an embodiment of the present invention, a resistance adjusting device used for a wheel of a training machine is provided with a stationary mechanism, a rotary mechanism, a plurality of magnets, a link member, a motor, a screw, and a nut. The stationary mechanism is fixed with the training machine. The rotary mechanism is pivoted to the stationary mechanism by a pivot and comprises a plurality of magnets for providing a resistance to the wheel. The link member pivotally connects to a first end of the rotary mechanism. The motor is connected with the link member. The screw includes a first end connected to the motor and is rotatable by the motor. The nut pivotally connects with the stationary mechanism, a second end of the screw passing through the nut and being movably engaged with the inner thread of the nut. The motor drives the screw to rotate, causing the rotary mechanism to rotate about the pivot, and thereby changing a distance between the plurality of magnets and the wheel, so as to increase or decrease the resistance.

In one embodiment, the resistance adjusting device further comprises an optical detection device for detecting the resistance and defining a minimum resistance and a maximum resistance.

In one embodiment, the optical detection device comprises a control circuit board, a control member, a first sensor, and a second sensor. The control circuit board electrically connects to the motor. The control member includes a first end fixed to the rotary mechanism and a second end suspended above the control circuit board. The first sensor is located on the control circuit board for detecting the second end of the control member so as to determine a minimum resistance position of the screw. The second sensor is located on the control circuit board for detecting the second end of the control member so as to determine a maximum resistance position of the screw.

In one embodiment, when the first sensor or the second sensor detects the second end of the control member, a stop signal is outputted to the motor, and the motor stops driving the screw according to the stop signal.

In one embodiment, each of the first sensor and the second sensor comprises an infrared emitter and an infrared receiver or comprises a light-emitting diode and a light receiver.

In one embodiment, the number of revolutions of the screw is determined according to a required resistance between the minimum resistance position and the maximum resistance position.

In one embodiment, the resistance adjusting device further comprises an emergency brake mechanism for stopping the wheel.

In one embodiment, the emergency brake mechanism comprises a trigger, a cable, a control block, a fixing piece, a spring, and a friction pad. The trigger is fixed with the training machine. The cable includes a first end and a second end, the first end of the cable being connected to the trigger. The control block is pivoted to the stationary mechanism, the second end of the cable being connected to the control block. The fixing piece is fixed with the stationary mechanism. The cable passes through the fixing piece and the spring. The spring includes a first end connected to the control block and a second end connected to the fixing piece. The friction pad is connected with the control block.

In one embodiment, the emergency brake mechanism comprises at least one friction pad located at least one side of the rotary mechanism, and the training machine comprises an emergency button for triggering a signal to instruct the motor driving the screw, causing the friction pad to contact the wheel so that the wheel is stopped.

In one embodiment, a self-lubricating bushing is provided between the pivot and the stationary mechanism.

DETAILED DESCRIPTION OF THE PREFERRED EMBODIMENT

Reference will now be made in detail to those specific embodiments of the invention. Examples of these embodiments are illustrated in accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

Figure 1A:
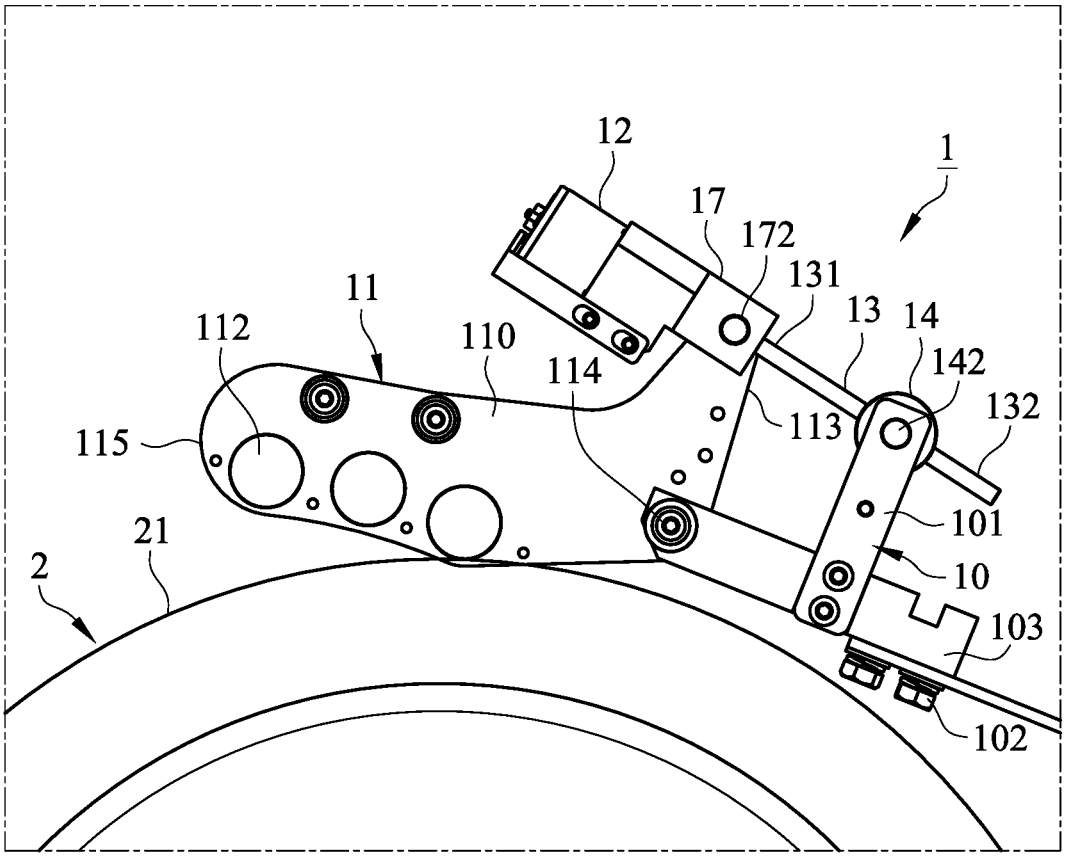
FIGS. 1A and 1B are front views showing a resistance regulating device for a wheel of a training machine in accordance with an embodiment of this invention.
Figure 1B:
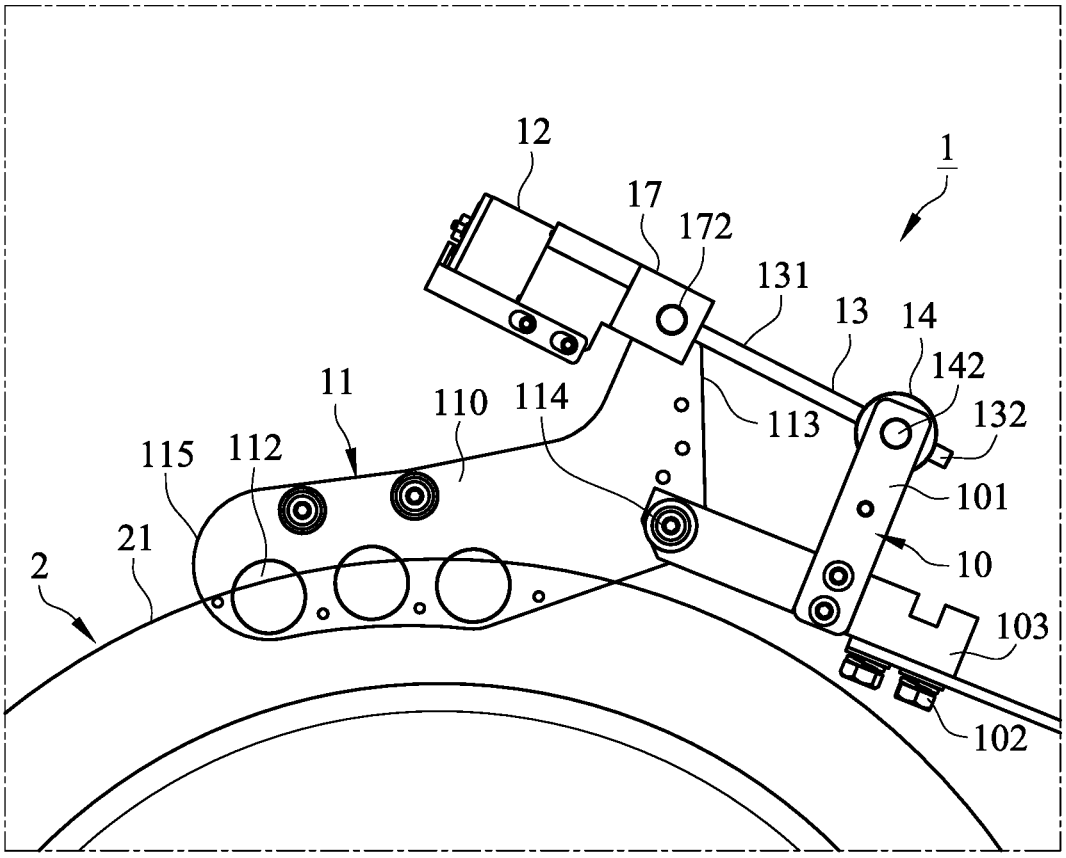
Figure 2A:
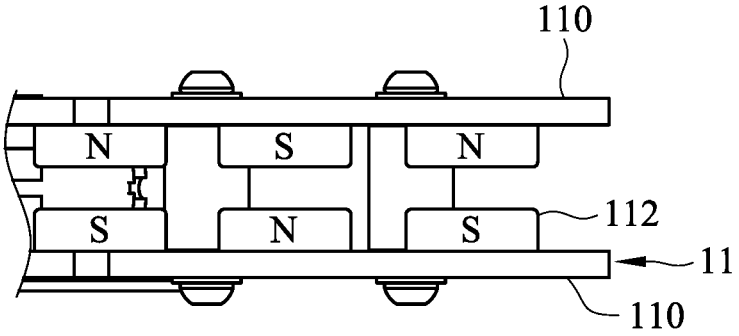
FIGS. 2A and 2B are partially top view and side view, respectively, showing the resistance regulating device for the wheel of the training machine in accordance with the embodiment of this invention.
Figure 2B:
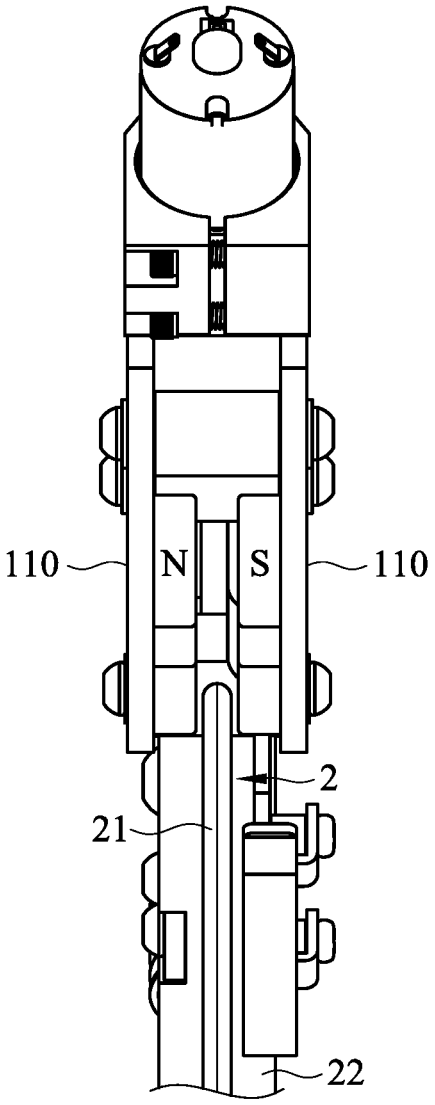

FIGS. 1A and 1B are side views showing a resistance regulating device 1 according to an embodiment of the present invention. FIG. 2A and FIG. 2B are top view and side view, respectively, showing that the resistance regulating device 1 of FIG. 1 is used for applying a resistance to a wheel 2 of a training machine (not shown). In some embodiments, the wheel 2 may be a flywheel, and the training machine may be any equipment having the wheel 2, such as a spinning bike, an elliptical cross trainer, a recumbent bike, or the like.

As shown in FIGS. 1A and 1B, the resistance regulating device 1 mainly includes a stationary mechanism 10, a rotary mechanism 11, a motor 12, a screw 13, a nut 14, and a link member 17.

As shown in FIGS. 1A and 1B, the stationary mechanism 10 is used for fixing with the training machine. In this embodiment, the stationary mechanism 10 may be a T-shaped structure, for example, a T-shaped structure formed by a first structure 101 and a second structure 103, and is fixed with the training machine through two fixing elements 102 such as screws.

As shown in FIGS. 2A and 2B, the rotary mechanism 11 may be constituted by two plates 110 with the same shape. A plurality of magnets 112 are arranged on the inner surface of each of the two plates 110. Two adjacent magnets 112 on the same plate 110 have opposite polarities, that is, one is N-pole and the other is S-pole. The polarity of any magnet 112 in one plate 110 is also opposite to the polarity of the corresponding magnet 112 in the other plate 110. The wheel 2 may include a metal portion 22, and the periphery of the metal portion 22 may have a non-magnetic ring 21, such as an aluminum ring. The wheel 2 is not limited to the above structure. Accordingly, when the magnets 112 approach the wheel 2, a resistance is generated. The closer the magnets 112 approach the wheel 2, the greater the resistance is generated.

As shown in FIGS. 1A and 1B, the nut 14 is pivotally connected to the stationary mechanism 10 at a pivot 142. A second end 132 of the screw 13 is movably engaged with the internal thread of the nut 14 and passes through the nut 14. A first end 131 of the screw 13 is connected to the motor 12 and can be driven by the motor 12 to rotate clockwise or counterclockwise. A first end 113 of the rotary mechanism 11 is pivotally connected to the link member 17 at a pivot 172, and the link member 17 is connected to the motor 12. In addition, the two plates 110 of the rotary mechanism 11 are pivoted to the stationary mechanism 10 by a pivot 114. As a result, when the motor 12 drives the screw 13 to rotate, the distance between the motor 12 and the nut 14 changes, causing the rotary mechanism 11 to rotate around the pivot 114, and hence causing the distance between the second end 115 of the rotary mechanism 11 and the wheel 2 to change, so that the distance between the magnets 112 and the non-magnetic ring 21 is changed and therefore the resistance is increased or decreased. FIG. 1A shows the case where the distance between the magnets 112 and the non-magnetic ring 21 is the farthest, and the resistance is the smallest. FIG. 1B shows the case where the distance between the magnets 112 and the non-magnetic ring 21 is the closest, and the resistance is the largest. Preferably, the pivot 114 is provided with a self-lubricating bushing (not shown), so as to increase the rotation stability and wear resistance of the rotary mechanism 11.

Figure 3A:
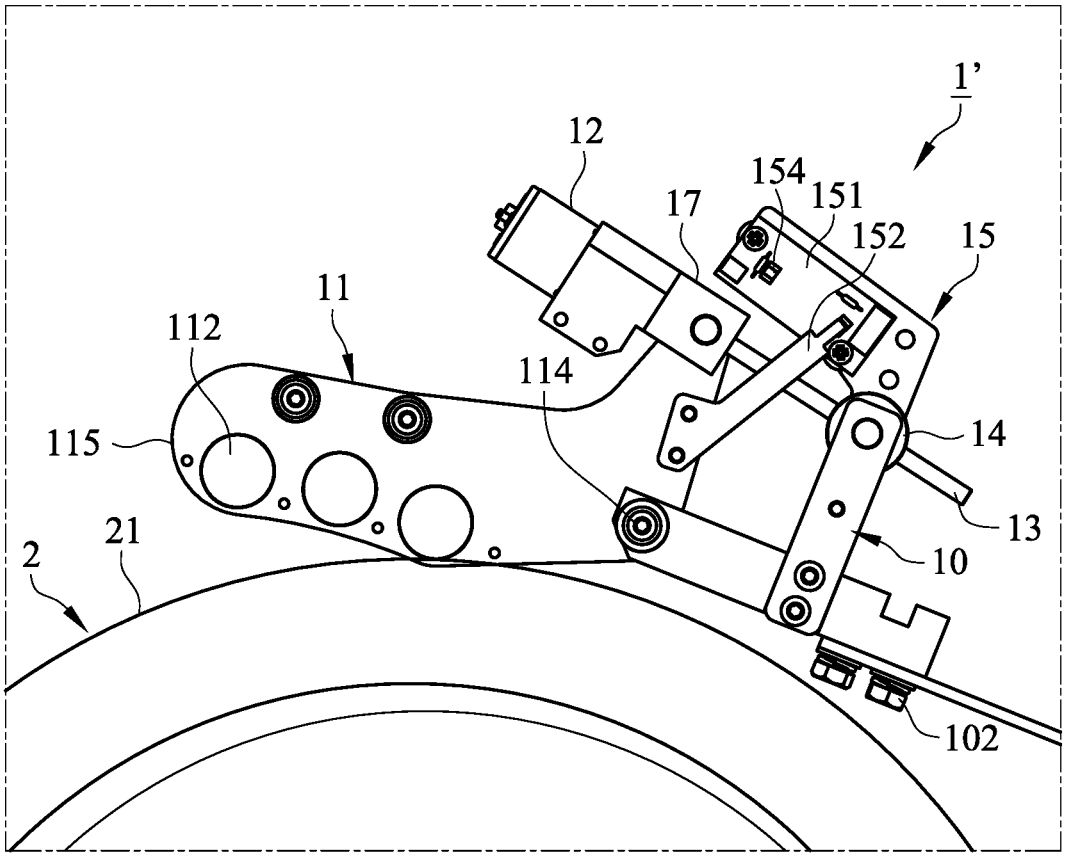
FIGS. 3A and 3B are front views showing a resistance regulating device for a wheel of a training machine in accordance with another embodiment of this invention.
Figure 3B:
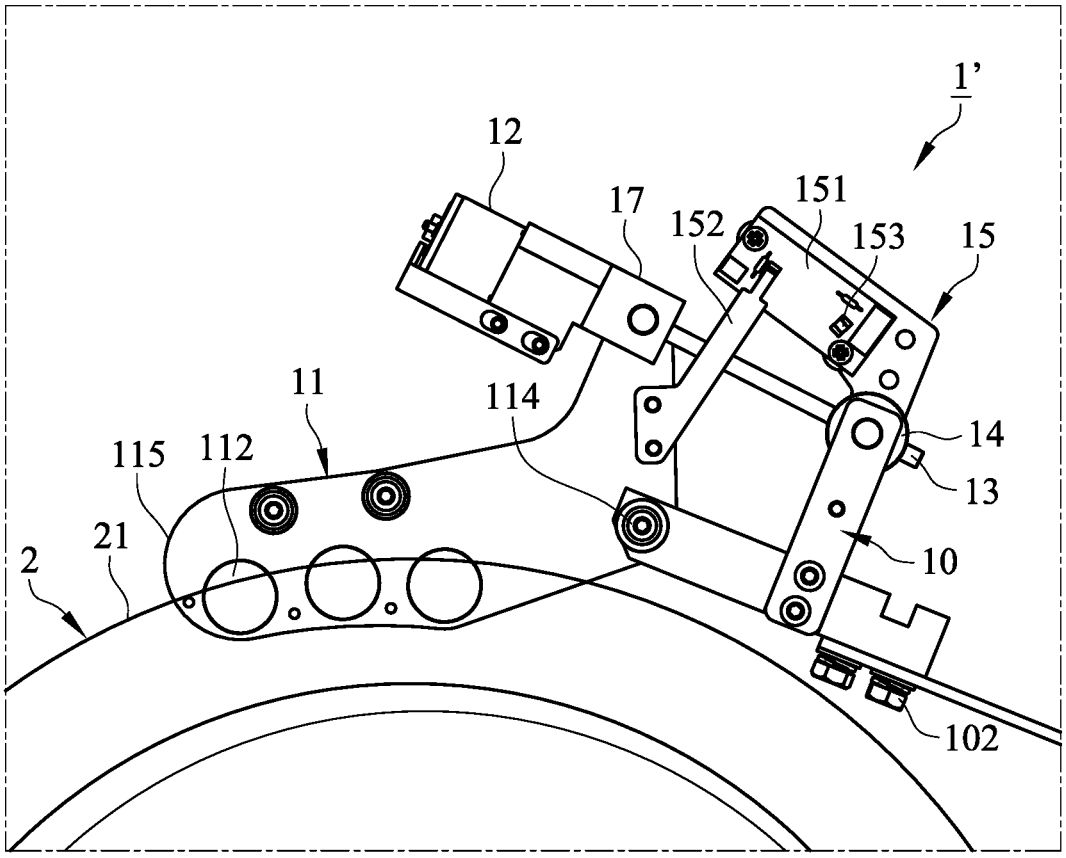

FIGS. 3A and 3B are front views showing a resistance regulating device 1' according to another embodiment of the present invention. In this preferred embodiment, the resistance regulating device 1' has the same components as the resistance regulating device 1, which includes the stationary mechanism 10, the rotary mechanism 11, the motor 12, the screw 13, the nut 14, and the link member 17. In addition, the resistance regulating device 1' further includes an optical detection device 15 for detecting the resistance and defining a minimum resistance and a maximum resistance. In the present embodiment, the optical detection device 15 includes a control circuit board 151 and a control member 152.

As shown in FIGS. 3A and 3B, in this embodiment, the control circuit board 151 includes two sensors, a first sensor 153 and a second sensor 154. The first sensor 153 is used to detect the minimum resistance, and the second sensor 154 is used to detect the maximum resistance. Each of the first sensor 153 and the second sensor 154 may be, but is not limited to, an infrared sensor or a light-emitting diode sensor. For example, the first sensor 153 and the second sensor 154 may respectively include an infrared emitter and an infrared receiver. When the light emitted by the infrared emitter is blocked and cannot be received by the infrared receiver, a signal may be triggered. For example, the first sensor 153 and the second sensor 154 may respectively include a light-emitting diode and a light receiver. When the light emitted from the light-emitting diode is blocked and cannot be received by the light receiver, a signal may be triggered. In addition, the control circuit board 151 can be electrically connected to the motor 12 through a wire (not shown).

As shown in FIGS. 3A and 3B, the control circuit board 151 is fixed with the stationary mechanism 10. One end (the lower end) of the control member 152 is fixed to the rotary mechanism 11, and the other end (the upper end) is suspended over the control circuit board 151. As shown in FIG.

3A, when the motor 12 and the screw 13 are at the initial position, i.e., the operating distance between the motor 12 and the nut 14 being the shortest and the distance between the magnets 112 and the non-magnetic ring 21 being the farthest, the upper end of the control member 152 is located over the first sensor 153 and detected by the first sensor 153. At this time, the resistance regulating device 1' does not apply any resistance to the wheel 2. At this time, the control circuit board 151 can output a stop signal to the motor 12 to stop the motor 12 from driving the screw 13. As shown in FIG. 3B, when the motor 12 drives the screw 13 to rotate, the rotary mechanism 11 is driven to rotate about the pivot 114, such that the upper end of the control member 152 is away from the first sensor 153 and moved toward the second sensor 154. When the motor 12 continues to drive the screw 13 to rotate to cause the operating distance between the motor 12 and the nut 14 to be the farthest and the distance between the magnets 112 and the non-magnetic ring 21 to be the closest, the upper end of the control member 152 is located over the second sensor 154 and detected by the second sensor 154. At this time, the resistance applied by the resistance regulating device 1' to the wheel 2 is the maximum, and the control circuit board 151 outputs a stop signal to the motor 12 to stop the motor 12 from driving the screw 13. In this embodiment, the control circuit board 151, the first sensor 153, and the second sensor 154 are employed to accurately adjust the resistance and improve the safety.

As shown in FIGS. 3A and 3B, the control circuit board 151 may be connected to a circuit board (not shown) of the training machine, and the circuit board of the training machine may be connected to a display panel (not shown) of the training machine. When the upper end of control member 152 is detected by the first sensor 153 and the second sensor 154, the motor 12 and screw 13 are at "the minimum resistance position" and "the maximum resistance position," respectively. The number of turns required to move the screw 13 from "the minimum resistance position" to "the maximum resistance position" can be recorded. In addition, when the screw 13 is at "the minimum resistance position" or "the maximum resistance position," the resistance of the wheel 2 at different speeds can be measured separately. In an embodiment, a torque tester (not shown) is disposed on a shaft of the wheel 2 for resistance measurement during the manufacture of the training machine. After measurement, the torque tester can be removed. In this way, the number of rotations of the screw 13 is converted into a resistance value and displayed on the display panel of the training machine. For example, when the user inputs a command through the display panel to adjust the wheel 2 to a certain resistance value, the circuit board or the control circuit board 151 can convert the resistance value into the corresponding number of rotations of the screw 13 and order the motor to drive the screw 13 with the required number of rotations. With the above method, a stepless accurate resistance control can be achieved.

As shown in FIGS. 3A and 3B, in another embodiment, the interval between "the minimum resistance position" and "the maximum resistance position" of the motor 12 and the screw 13 is divided into a certain number of resistance levels, such as 20 levels. During the manufacture of training machine, the resistances applied to the wheel 2 are measured by the torque tester when the screw 13 at positions corresponding to the resistance levels and at the minimum and maximum resistance position and the wheel 2 is rotated at different rotational speeds (for example, 30 rpm, 60 rpm, 90 rpm, 100 rpm, 120 rpm). Since the number of turns needed to rotate the screw 13 for these resistance levels is known, the adjustment can be made according to the resistance level required and inputted by the user.

Figure 4A:
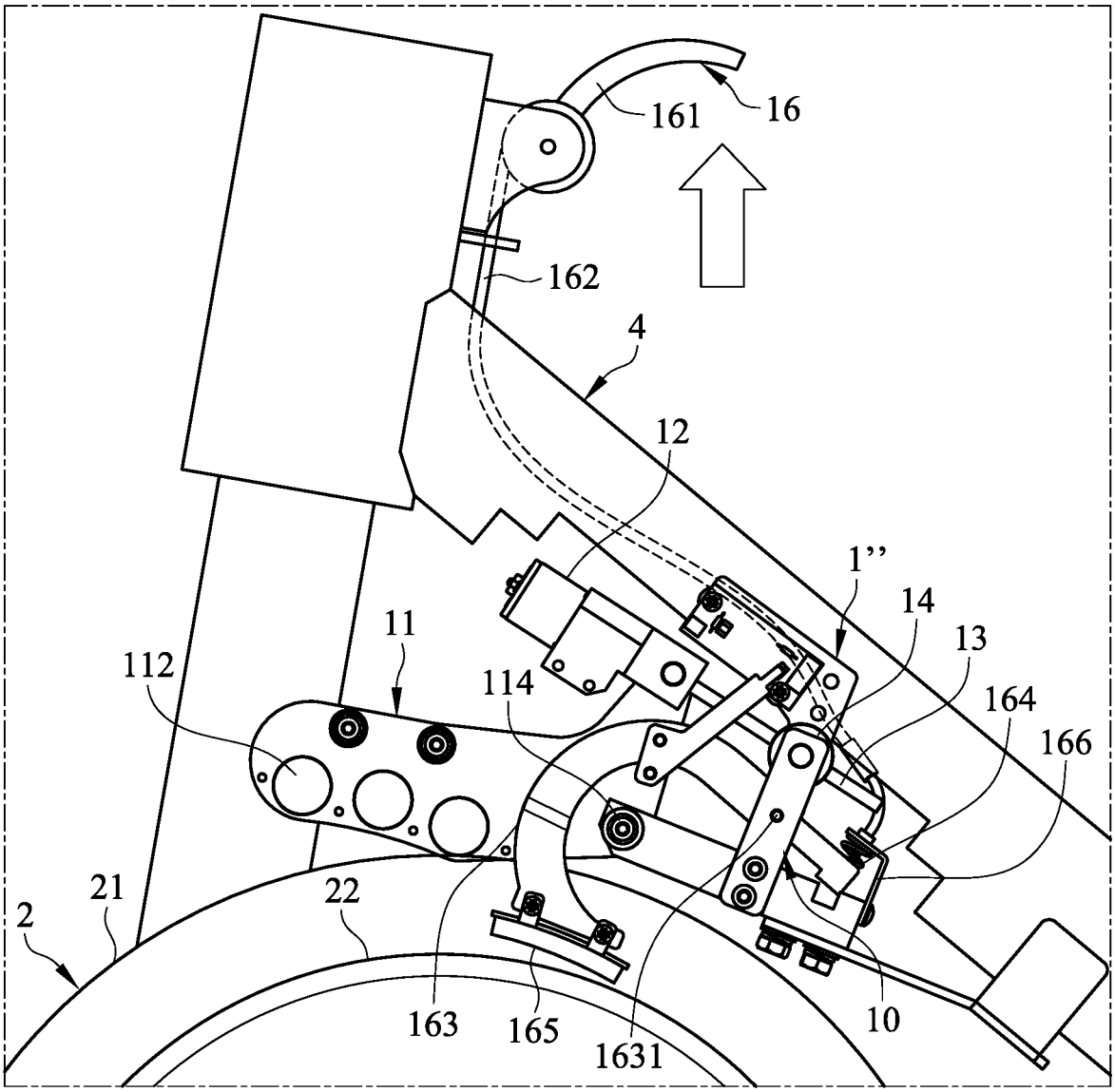
FIGS. 4A and 4B are front views showing a resistance regulating device for a wheel of a training machine in accordance with another embodiment of this invention.
Figure 4B:
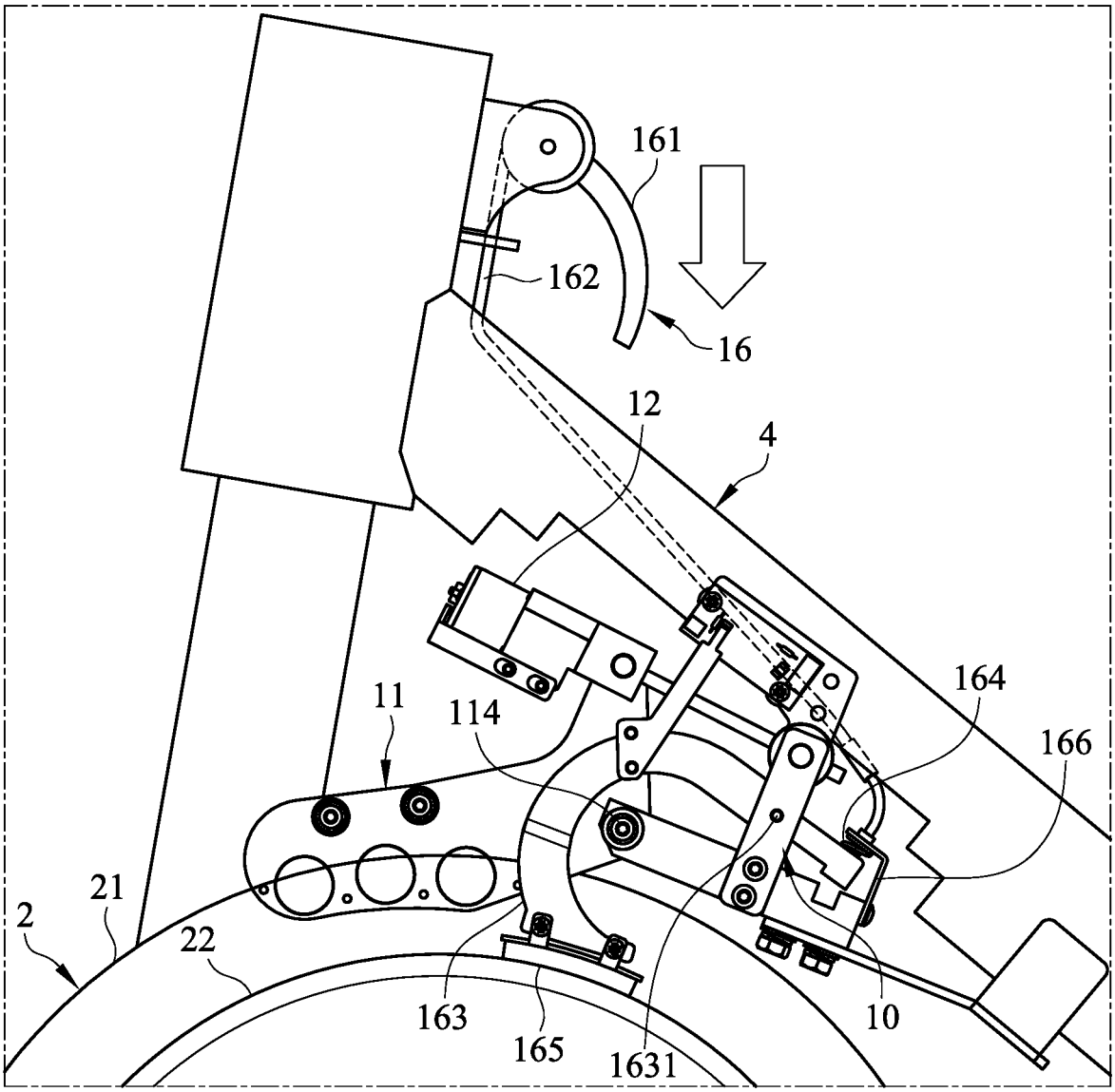

FIGS. 4A and 4B are front views showing a resistance regulating device 1" applied to a training machine 4 in accordance with another embodiment of the present invention. The resistance regulating device 1" includes the same components as the resistance regulating device 1'. In addition, in order to enhance safety, the resistance regulating device 1" further includes an emergency brake mechanism 16. In this embodiment, the emergency brake mechanism 16 includes a trigger 161, a cable 162, a control block 163, a spring 164, a friction pad 165, and a fixing piece 166. The trigger 161 is fixed with the training machine 4. The control block 163 is pivoted to the stationary mechanism 10 by a pivot 1631. The fixing piece 166 is fixed with the stationary mechanism 10. One end of the cable 162 is connected with the trigger 161, and the other end passes through the fixing piece 166 and connects one end of the control block 163, and the other end of the control block 163 is connected to the friction pad 165. The cable 162 passes through the spring 164, one end of the spring 164 connects to the control block 163 and the other end connects the fixing piece 166.

As shown in FIG. 4A, when the trigger 161 is in the initial position, the friction pad 165 is not in contact with the metal portion 22 of the wheel 2, and the wheel 2 can continue to rotate. At this time the spring 164 is not compressed. As shown in FIG. 4B, when the wheel 2 needs to be stopped urgently, the user pushes the trigger 161 downward. At this moment, the cable 162 pulls the control block 163 to rotate anticlockwise about the pivot 1631, causing the friction pad 165 in contact with the metal portion 22 of the wheel 2, so that the wheel 2 is stopped and at the same time the spring 164 is compressed by the control block 163. Preferably, the friction pad 165 is wool felt. In another embodiment, the friction pad 165 is rubber. When the trigger 161 returns to the position of FIG. 4A, the elasticity of the spring 164 causes the control block 163 to return to the position shown in FIG. 4A. The resistance regulating device 1" provided in this embodiment can further improve the safety during the operation.

Figure 5A:
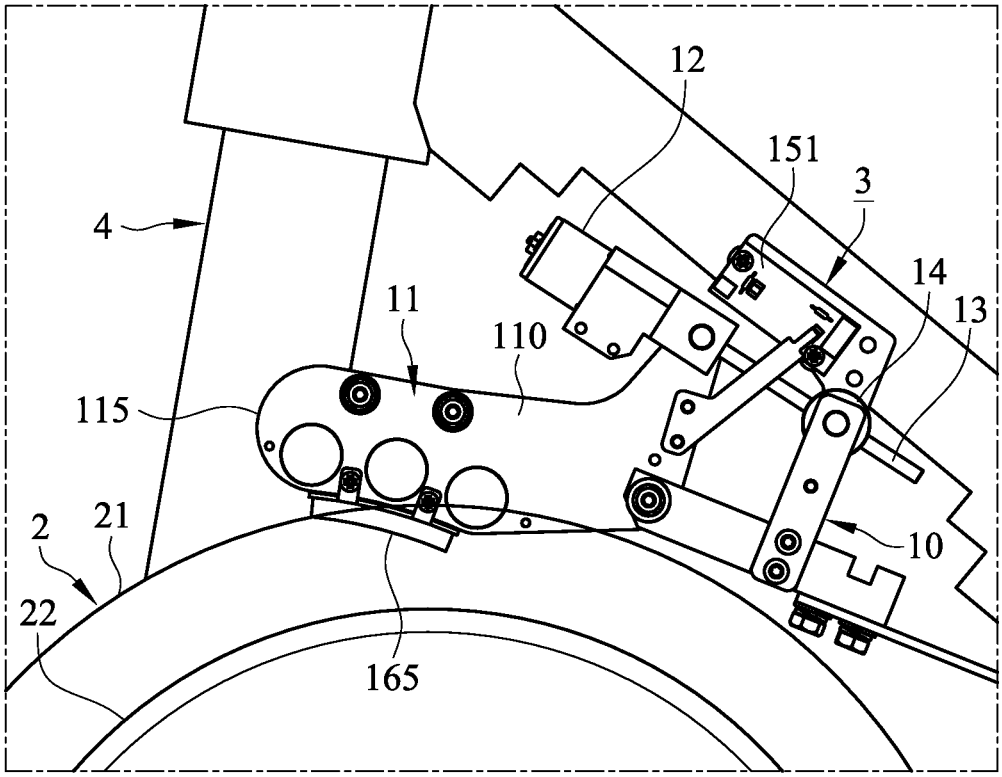
FIGS. 5A and 5B are front views showing a resistance regulating device for a wheel of a training machine in accordance with another embodiment of this invention.
Figure 5B:
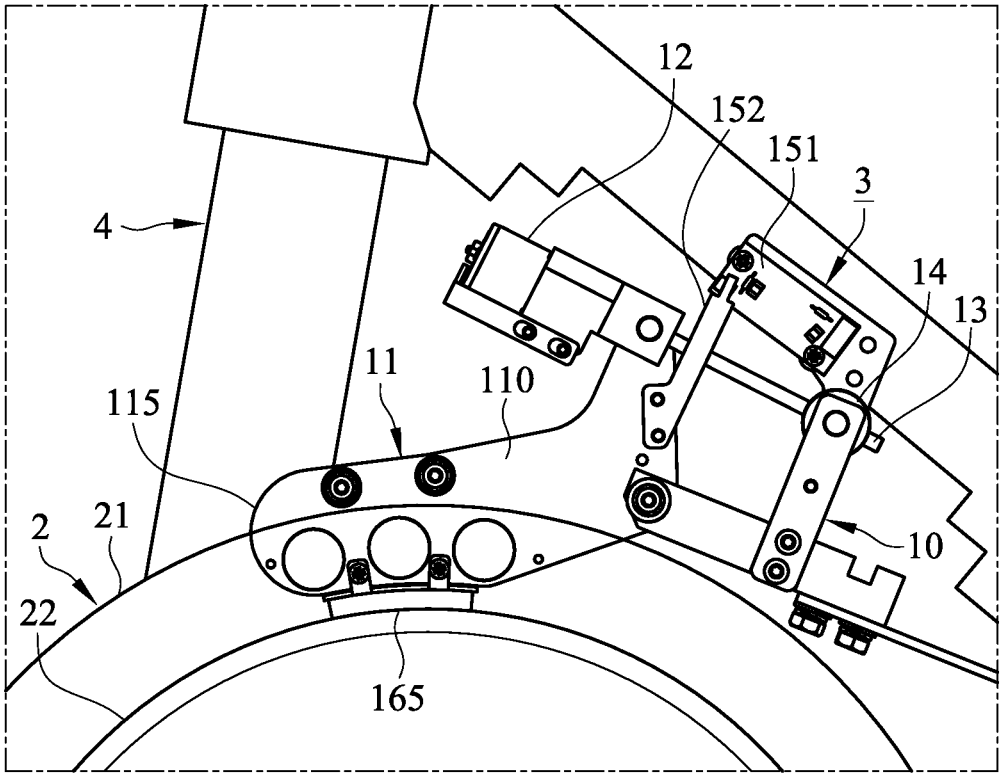

FIGS. 5A and 5B are front views showing a resistance regulating device 3 applied to a training machine in accordance with another embodiment of the present invention. The resistance regulating device 3 has the same components as the resistance regulating device 1'. In addition, in order to enhance safety, the resistance regulating device 3 further includes a friction pad 165. The friction pad 165 is disposed on the plate 110 at one side of the second end 115 of the rotary mechanism 11. In another embodiment, there are two friction pads 165 respectively disposed on the plates 110 at the two sides of the second end 115 of the rotary mechanism 11. A virtual or real emergency stop button (not shown) may be provided on the display panel or the training machine 4. As shown in FIG. 5A, when the emergency stop button is not pressed, the friction pad 165 is not in contact with the wheel 2, and the wheel 2 can be continuously rotated. When the wheel 2 needs to be stopped urgently, the user presses the emergency stop button 2 and then the circuit board or the control circuit board 151 will issue a command, so that the motor 12 drives the screw 13 to rotate beyond the maximum resistance position (ignoring the stop signal generated at the maximum resistance position) until the friction pad 165 contacts the metal portion 22 of the wheel 2, resulting in the wheel 2 being stopped.

According to the resistance regulating device of each embodiment of the present invention, the resistance applied to the wheel can be precisely adjusted and the safety of operation can be improved.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A resistance adjusting device used for a wheel of a training machine, comprising:

a stationary mechanism being fixed with the training machine;

a rotary mechanism being pivoted to the stationary mechanism by a pivot and comprising a plurality of magnets for providing a resistance to the wheel;

a link member pivotally connecting to a first end of the rotary mechanism;

a motor being connected with the link member;

a screw having a first end connected to the motor and being rotatable by the motor;

a nut pivotally connecting with the stationary mechanism, a second end of the screw passing through the nut and being movably engaged with an inner thread of the nut; and an optical detection device for detecting the resistance and defining a minimum resistance and a maximum resistance;

wherein the optical detection device comprises:

a control circuit board electrically connected to the motor;

a control member having a first end fixed to the rotary mechanism and a second end suspended above the control circuit board;

a first sensor located on the control circuit board for detecting the second end of the control member so as to determine a minimum resistance position of the screw; and a second sensor located on the control circuit board for detecting the second end of the control member so as to determine a maximum resistance position of the screw;

whereby the motor drives the screw to rotate, causing the rotary mechanism to rotate about the pivot, and thereby changing a distance between the plurality of magnets and the wheel, so as to increase or decrease the resistance.

2. The resistance adjusting device as set forth in claim 1, further comprising an emergency brake mechanism for stopping the wheel.

3. The resistance adjusting device as set forth in claim 2, wherein the emergency brake mechanism comprises:

a trigger fixed with the training machine;

a cable having a first end and a second end, the first end of the cable being connected to the trigger;

a control block being pivoted to the stationary mechanism, the second end of the cable being connected to the control block;

a fixing piece fixed with the stationary mechanism;

a spring, the cable passing through the fixing piece and the spring, the spring having a first end connected to the control block and a second end connected to the fixing piece; and a friction pad connected with the control block.

4. The resistance adjusting device as set forth in claim 2, wherein the emergency brake mechanism comprises at least one friction pad located at least one side of the rotary mechanism, and the training machine comprises an emergency button for triggering a signal to instruct the motor driving the screw, causing the at least one friction pad to contact the wheel so that the wheel is stopped.

5. The resistance adjusting device as set forth in claim 1, wherein when the first sensor or the second sensor detects the second end of the control member, a stop signal is outputted to the motor, and the motor stops driving the screw according to the stop signal.

6. The resistance adjusting device as set forth in claim 1, wherein each the first sensor and the second sensor comprises an infrared emitter and an infrared receiver or comprises a light-emitting diode and a light receiver.

7. The resistance adjusting device as set forth in claim 1, wherein a number of revolutions of the screw is determined according to a required resistance corresponding to a position between the minimum resistance position and the maximum resistance position of the screw.

8. The resistance adjusting device as set forth in claim 1, wherein a self-lubricating bushing is provided between the pivot and the stationary mechanism.

* * * * *